US005705962A

United States Patent [19]

Fleeger et al.

[11] Patent Number: 5,705,962

[45] Date of Patent: Jan. 6, 1998

[54] MICROWAVE POWER DIVIDERS AND COMBINERS HAVING AN ADJUSTABLE TERMINATING RESISTOR

[75] Inventors: Robert G. Fleeger, Fullerton; Alan L. Kovacs, Long Beach, both of Calif.

[73] Assignee: Hughes Electronics, Los Angeles, Calif.

[21] Appl. No.: 775,323

[22] Filed: Dec. 31, 1996

[51] Int. Cl.[6] ..... H01P 5/12

[52] U.S. Cl. ..... 333/136; 333/125; 333/128; 338/195

[58] Field of Search ..... 333/124, 125, 333/127, 128, 136; 338/13, 195, 307–309

[56] References Cited

U.S. PATENT DOCUMENTS

| | | | |
|---|---|---|---|
| 4,450,418 | 5/1984 | Yum et al. | 333/128 |
| 4,639,694 | 1/1987 | Seino et al. | 333/128 |
| 4,737,747 | 4/1988 | Henderson et al. | 333/128 X |

FOREIGN PATENT DOCUMENTS

| | | | |
|---|---|---|---|
| 0246003 | 10/1988 | Japan | 333/128 |

*Primary Examiner*—Robert Pascal
*Assistant Examiner*—Barbara Summons
*Attorney, Agent, or Firm*—Leonard A. Alkov; Wanda K. Denson-Low

[57] ABSTRACT

Microwave apparatus, such as microwave power dividers or combiners, having an adjustable terminating resistor. The present invention allows adjusting or trimming of the resistor and pretesting of substrates on which the apparatus is formed prior to installation of expensive integrated circuit components. The microwave power divider or combiner has a central contact disposed at a midpoint of the terminating resistor. This central contact is thus disposed at the midpoint of the terminating resistor and is coupled to a test point. Outer edges of the central contact are constructed to be parallel to inner edges of impedance paths or traces over which the terminating resistor lies so that each section of the terminating resistor has substantially the same resistance value.

14 Claims, 2 Drawing Sheets

MICROWAVE POWER DIVIDERS AND COMBINERS HAVING AN ADJUSTABLE TERMINATING RESISTOR

BACKGROUND

The present invention relates generally to microwave power dividers and combiners, and more particularly, to a microwave power divider and combiner having a adjustable terminating resistor.

Prior art relating to the present invention is disclosed in a paper by E. J. Wilkinson entitled "An N-way Power Divider", IRE Transactions, Microwave Theory Tech, volume MTT-8, pages 116–118, Jan. 1960, and a paper by S. B. Cohn entitled "A Class of Broadband TEM Mode Hybrids", published in IEEE Transactions Microwave Theory and Techniques, MTT-16, pages 110–116, Feb. 1968. The basic issue with the microwave power divider designs disclosed in these papers relates to problems in manufacturing the termination resistance to a tight tolerance.

For typical three port circuits, such as are shown in the drawing figures, the optimum termination resistance is typically twice Zc. This is important because of the interaction between the termination resistance and the maximum achievable isolation between the ports of the circuit. This makes the quality of the termination critical in achieving a high manufacturing yield. A deviation of one percent reduces the achievable isolation by several dB.

Printing precision thick film resistor values is difficult, and in most applications, the requisite precision is achieved by printing a initial value of about 80% of that desired, then employing a means to measure the resistance while using another means to remove small amounts of the resistive material until the resistance has increased to the desired value. This technique cannot be used to measure and adjust these terminating resistors because the arms of a conventional power divider have a DC short circuit across it.

In addition, because the conventional design does not allow pretesting the substrate, the other components are assembled with a part of unknown quality and performance. This is especially important for power divider structures that are buried within a dielectric material such as low temperature cofired ceramic as an integral part of complex microwave assemblies because the resulting yield loss cost of value added subassemblies containing microwave integrated circuit components is very high.

The yield of Wilkinson type power dividers is dependent upon manufacturing the thick film terminating resistor to a tight tolerance. Without a means for easily measuring and adjusting the final value, the associated yield loss is much greater, or the port isolation is much lower than if standard resistor fabrication techniques could be used.

More particularly, the yield of Wilkinson-type power dividers is primarily determined by the ability to print an accurate terminating resistor typically in the range of 100 ohms. Trimming this resistor to a precise value is virtually impossible because arms of the power divider have a DC short across it. Yield loss associated with conventional power dividers is much higher than if the termination could be measured and trimmed using standard resistor fabrication techniques. In addition, these conventional terminating resistor designs do not allow pretesting or trimming of the substrate prior to component installation or assembly. This results in expensive yield losses of high value-added subassemblies which may contain expensive integrated circuit components that fail post-assembly testing because of an inaccurate termination reducing the port isolation.

Accordingly, it is an objective of the present invention to provide for improved microwave apparatus, such as power dividers and combiners, having an adjustable terminating resistor.

SUMMARY OF THE INVENTION

To meet the above and other objectives, the present invention provides for microwave apparatus, including microwave power dividers and combiners, that have an adjustable terminating resistor that allows the resistors to be adjusted and permits pretesting of substrates on which the power divider or combiner is formed prior to installation of expensive integrated circuit components. The improved design of the present invention provides for a central contact disposed at the midpoint of the terminating resistor. This for a test of the terminating resistor. The edges of the central contact are parallel to edges of impedance paths over which the terminating resistor lies. This ensures that each section or half of the resistor disposed on either side of the central contact have substantially equal resistance values. The central contact is coupled by way of a via or high impedance line to a test point or test port.

The test point allows conventional processing without incurring additional costs associated with the high yield loss or the recurring cost of periodically reopotimizing the resistor manufacturing process. The termination of the microwave power divider or combiner may be tested and trimmed to an optimum value prior to installation of integrated circuit components, so that defects can be uncovered and corrected before the expensive integrated circuits or chip sets are installed onto the substrate.

Both sections or halves of the resistor are fabricated simultaneously and receive identical processing, and are therefore well matched to each other in terms of their resistance value. The nominal values of the two resistor halves may differ considerably from the desired value, but as long as the sections are well matched to each other, the resistance value measured between the test point and any of the RF ports of the microwave power divider ports produces a value equal to one fourth of the total termination resistance.

By spot trimming each resistor section equally, the initial ratio match between them will be maintained as the total termination resistance be increased. This trimming procedure is continued until the measured resistance is one fourth of the desired termination resistance.

By adding the central contact and test point and configuring the traces of the power divider so that the terminating resistor has sections that are matched in resistance, increased yields in thick or thin film processing are realized. In addition, higher level assembly yields are provided since high value MMIC chip sets, for example, are only installed on known good substrates determined from the substrate testing. Thus, the present invention provides for a power divider or combiner having improved RF performance over jumpered cutout designs, increased test margins and reduced costs. This invention is especially useful for power dividers or combiners employed in buried structures where the use of cutouts are not practical.

Any thick or thin film or cofired circuit may be adapted to incorporate the present invention. The present invention is especially applicable to multilayer substrate circuits where the power divider or combiner is incorporated as a buried feature typically used in sophisticated microwave integrated circuits, for example.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
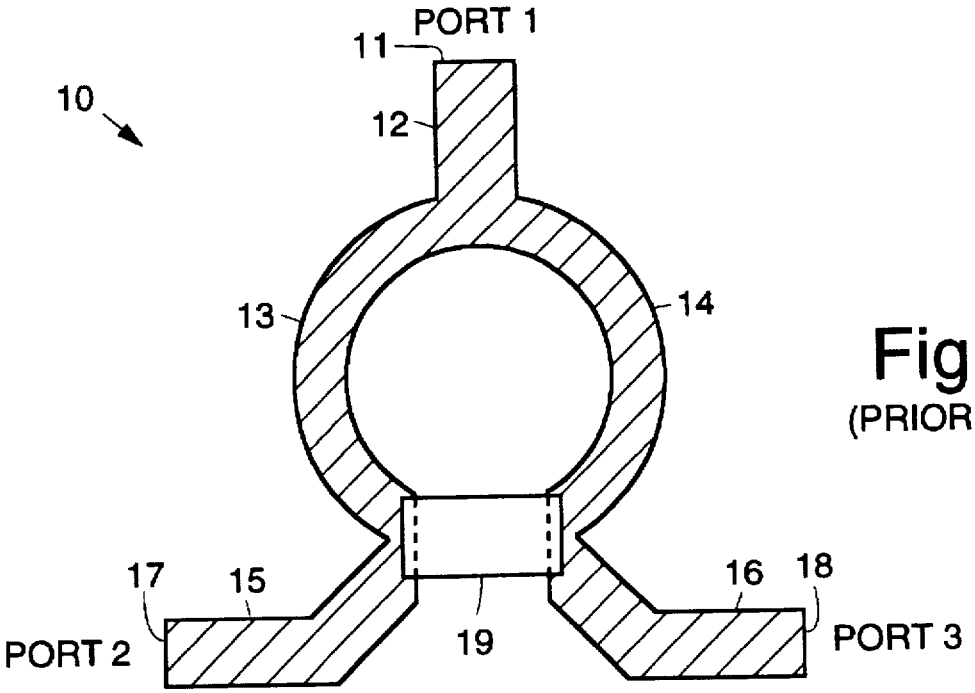
Fig. 1 (PRIOR ART)
FIGS. 1–3 illustrate conventional microwave power dividers which are improved upon by the present invention.

Referring to the drawing figures, FIG. 1 illustrates a conventional Wilkinson-type microwave power divider 10 which is improved upon by the present invention. The conventional power divider 10 includes a first port 11 (PORT 1) that is coupled by way of a first impedance path 12 (having a nominal impedance value Zc) that splits along two output paths 13, 14 each having a length of $\lambda/4$ (relative to the operating frequency) and a typical impedance value of $\sqrt{2}(Zc)$, which are respectively coupled to second and third impedance paths 15, 16 (typically having an impedance value Zc) to second and third ports 17, 18 (PORT 2, PORT 3). A single terminating resistor 19 having a nominal impedance value 2Zc is coupled between the second and third impedance paths 15, 16.

This RF circuit of FIG. 1 places a DC short circuit across the terminating resistor 19. Performance is highly dependent on the terminating resistor 19 printing process capability, which has a nominal accuracy of ±20% for surface printing. Buried terminating resistors 19 have even higher initial variability.

The production yield of Wilkinson-type power dividers 10, such as the power divider 10 shown in FIG. 1, is primarily determined by the ability to print an accurate terminating resistor 19. Trimming this terminating resistor 19 to a precise value is virtually impossible because arms of the power divider have a DC short across them.

Figure 2:
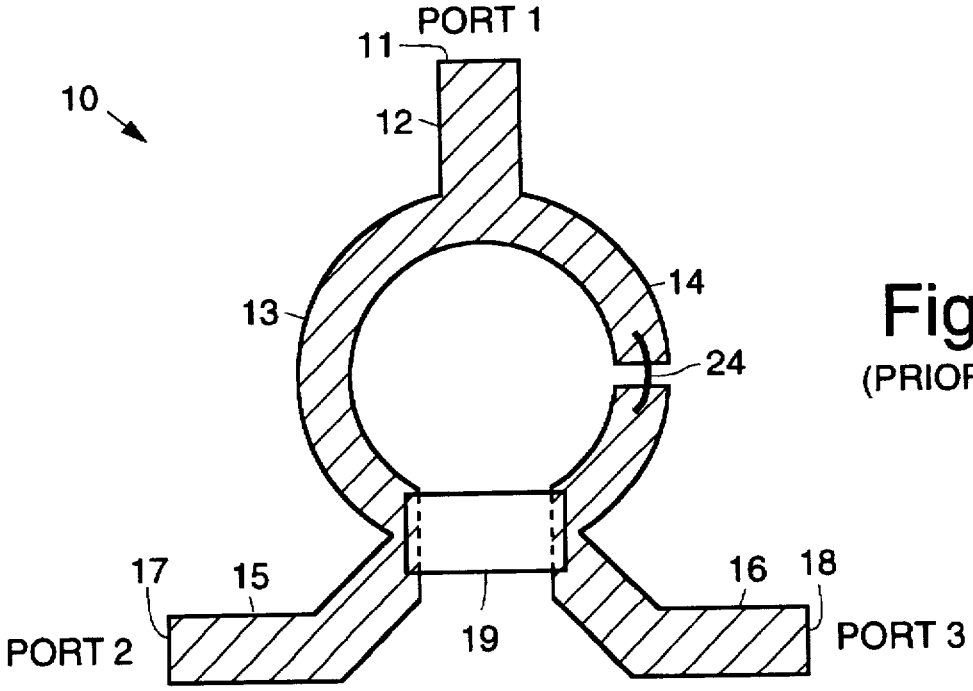
Fig. 2 (PRIOR ART)

FIG. 2 illustrates a second conventional Wilkinson-type microwave power divider 10 implemented using microstrip which uses a jumpered cutout 24 to allow the terminating resistor 19 to be measured. This power divider 10 is substantially the same at that shown in FIG. 1, but the second impedance path 14 is cut to provide the cutout 24. The resistor 19 may be measured by connecting an ohm meter to the two portions of the second impedance path 14 on either side of the cutout 24. Then a wire bond 25 is used to reconnect to two portions of the second impedance path 14. However, the RF performance of such Wilkinson-type power dividers 10 is much better using a continuous structure.

Typically the resistors 19 shown in FIGS. 1 and 2 are printed on a substrate layer using thick film techniques. The first pass accuracy of buried resistors manufactured using thick film processing techniques is about ±50%. With tailoring and optimization of the design and process, absolute accuracies of about ±20% can be achieved. Unfortunately this optimization process must be repeated for each new batch of resistive ink. This low process capability combined with the sensitivity of the isolation performance to the termination resistance value means that in all but the most mediocre applications, the associated yield loss for these power dividers 10 would be much higher than necessary without the ability to accurately measure and adjust the value of the terminating resistor 19 after the substrate is fabricated but before components are installed. This problem is addressed by the present invention.

Figure 3:
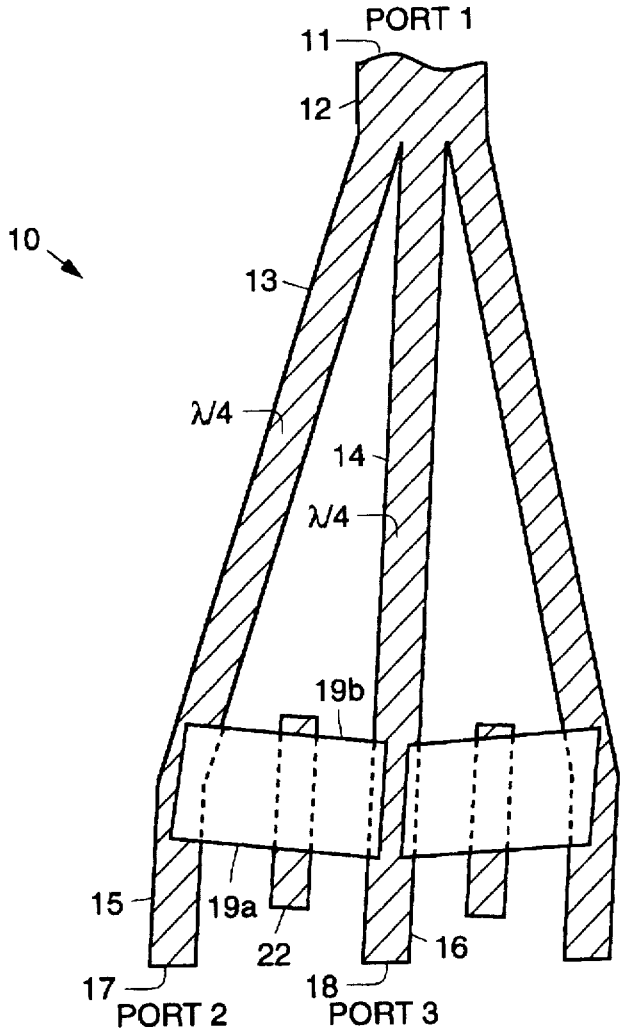
Fig. 3 (PRIOR ART)

FIG. 3 illustrates a portion of a four port (three-way) Wilkinson-type power divider 10 that was developed by the assignee of the present invention over ten years ago and used in a transmit and receive (T/R) module of an antenna array. At first glance, this power divider 10 is similar to the present invention to be described below, but in fact is different and is quite illustrative of the problem that the present invention solves.

The power divider 10 includes a central contact 22 disposed between the traces corresponding to the output path 13, and the second and third impedance paths 15, 16. The terminating resistor 19 is printed so that it overlays the central contact 22, thus forming two resistor sections **19*a*, 19*b* or halves 19*a*, 19*b*. However, comparing the two resistor sections 19*a*, 19*b* reveals that they are not matched in resistance. In particular, at the juncture between the first resistor section, the output path 13, and the second impedance path 15, it is seen that the outline of the traces defining the output path 13 and the second impedance path 15 are not parallel to the adjacent edge of the central contact 22. Thus, the two resistor sections 19*a*, 19*b* do not have the same impedance value. This is the same for the resistor sections of the opposite side of the power divider 10. The various resistor sections 19*a*, 19*b* cannot be trimmed accurately given the design of this conventional power divider 10**. This problem is rectified by the present invention.

Figure 4:
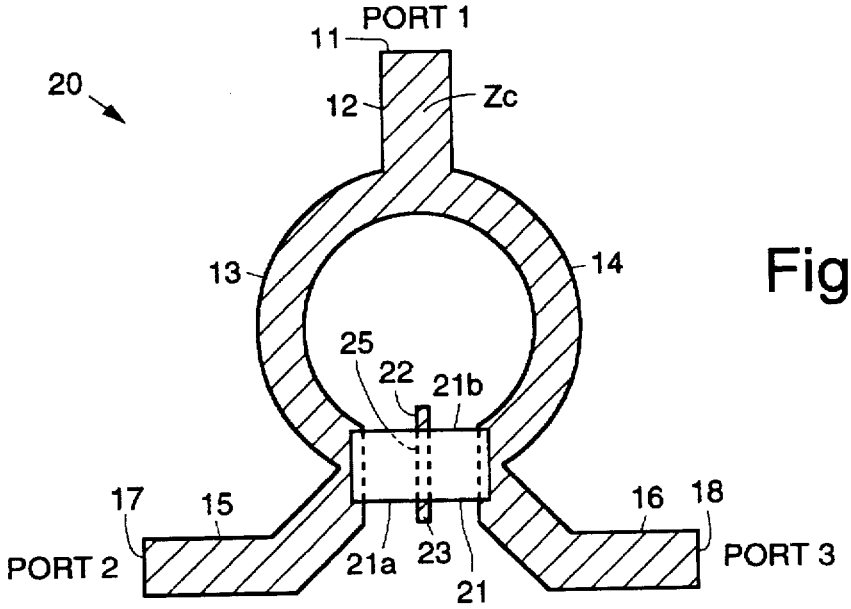
FIG. 4 illustrates a microwave power divider having a trimmable terminating resistor in accordance with the principles of the present invention.

Referring now to FIG. 4, it illustrates a microwave power divider 20 having a adjustable terminating resistor 21 in accordance with the principles of the present invention. The microwave power divider 20 is constructed in substantially the same manner as a conventional microwave power divider 10, except that the adjustable terminating resistor 21 is formed in place of the conventional terminating resistor 19. The adjustable terminating resistor 21 comprises first and second resistor sections **21*a*, 21*b* that are coupled between the second and third impedance paths 15, 16 and a central contact 22 is disposed at a midpoint of the adjustable terminating resistor 21**.

Outer edges of the central contact 22 are constructed to be parallel to inner edges of the second and third impedance paths 15, 16 over which the terminating resistor 21 lies. This ensures that each section **21*a*, 21*b* or half 21*a*, 21*b* of the adjustable terminating resistor 21 disposed on either side of the central contact 22** have substantially equal resistance values.

A test port 23 or test point 23 is coupled to the central contact 22 by way of a via or high impedance line 25 which permits testing of the microwave power divider 20. The central contact 22 is fabricated by printing or deposition and is disposed along a centerline of the trace defining the first port 11. Optionally, the test point 23 may be designed to facilitate a Kelvin probe connection to increase measurement accuracy.

The resistance measurement error is a function of the error in the resistance ratio between the two resistor sections **21*a*, 21*b* in the microwave power divider 20. The error in computing and trimming the terminating resistor 21** over the range of process capabilities is small compared to those of printing an absolute value, and much easier than blind trimming during RF testing.

The nominal value of the two resistor sections **21*a*, 21*b* may differ considerably from the desired value, but as long as the sections 21*a*, 21*b* are well matched to each other, which is substantially insured by the design of the present invention, the resistance value measured between the test point 23 and any of the RF ports 11, 17, 18 of the microwave power divider 20 produces a value equal to one fourth of the total termination resistance. By spot trimming each resistor section 21***a*, 21*b* equally, the initial ratio match between them will be maintained as the total termination resistance is increased. This trimming procedure is continued until the measured resistance is one fourth of the desired termination resistance.

In a preferred embodiment of the microwave power divider 20, a via or a circuit trace is used to connect the central contact 22 to a test point at the surface of a low temperature cofired ceramic (LTCC) package to allow measurement of the resistance of the two resistor sections 21*a*, 21*b*. The dimensions of the via or trace are selected to exhibit a very high impedance at operating frequencies thus isolating the test point 23 from the circuit so that it does not adversely affect the microwave performance.

In its preferred embodiment, the present invention sandwiches the power divider 20 between layers of low temperature cofired ceramic, eliminating a metallic housing that have been used in conventional designs. The present invention provides for a microwave power divider 20 (or combiner) that is completely encapsulated within a block formed by stacking multiple layers of green ceramic tape having circuit conductors and resistors printed on the layers, and which is fired to create a sealed, solid ceramic housing for the power divider 20.

Thus, improved microwave apparatus, such as power dividers and combiners, having an adjustable terminating resistor has been disclosed. It is to be understood that the described embodiments are merely illustrative of some of the many specific embodiments which represent applications of the principles of the present invention. Clearly, numerous and other arrangements can be readily devised by those skilled in the art without departing from the scope of the invention.

What is claimed is:

1. Microwave apparatus comprising:

a first port coupled to a first impedance path that splits along two paths;

second and third impedance paths respectively coupled to the two paths;

second and third ports coupled to the second and third impedance paths, respectively;

a central contact disposed at a midpoint between respective inner edges of the second and third impedance paths; and an adjustable terminating resistor overlying the respective inner edges of the second and third impedance paths and the central contact that forms first and second resistor sections disposed on either side of the central contact;

and wherein outer edges of the central contact are substantially parallel to the inner edges of the second and third impedance paths over which the terminating resistor lies so that each section of the resistor has substantially the same resistance value.

2. The apparatus of claim 1 wherein the central contact is coupled by way of a via to a test point that permits testing of the microwave apparatus.

3. The apparatus of claim 1 wherein the central contact is coupled by way of a high impedance line to a test point that permits testing of the microwave apparatus.

4. The apparatus of claim 3 wherein the central contact is disposed along a centerline of the first port.

5. The apparatus of claim 3 wherein the central contact comprises a printed central contact.

6. The apparatus of claim 3 wherein the central contact comprises a deposited central contact.

7. The apparatus of claim 1 further comprising a test port connected to the central contact for testing the microwave apparatus.

8. Microwave apparatus comprising:

a first port coupled to a first impedance path having an impedance value Zc, that splits along two paths each having a nominal length of $\lambda/4$ and a nominal impedance value of $\sqrt{2}(Zc)$;

second and third impedance paths, each having an impedance value Zc, respectively coupled to the two paths;

second and third ports coupled to the second and third impedance paths, respectively;

a central contact disposed at a midpoint between respective inner edges of the second and third impedance paths; and an adjustable terminating resistor overlying the respective inner edges of the second and third impedance paths and the central contact that comprises first and second resistor sections disposed on either side of the central contact;

and wherein outer edges of the central contact are substantially parallel to the inner edges of the second and third impedance paths over which the terminating resistor lies so that each section of the resistor has substantially the same resistance value.

9. The apparatus of claim 8 wherein the central contact is coupled by way of a via to a test point that permits testing of the microwave apparatus.

10. The apparatus of claim 8 wherein the central contact is coupled by way of a high impedance line to a test point that permits testing of the microwave apparatus.

11. The apparatus of claim 10 wherein the central contact is disposed along a centerline of the first port.

12. The apparatus of claim 10 wherein the central contact comprises a printed central contact.

13. The apparatus of claim 10 wherein the central contact comprises a deposited central contact.

14. The apparatus of claim 8 further comprising a test port connected to the central contact for testing the microwave apparatus.

* * * * *